US008701930B2

(12) United States Patent
Mithal et al.

(10) Patent No.: US 8,701,930 B2
(45) Date of Patent: Apr. 22, 2014

(54) LID FEATURING EASE OF USE AND IMPROVED RELEASE FROM A TRAY OR CONTAINER

(75) Inventors: Ashish K. Mithal, North Chelmsford, MA (US); Matthew J. Wichmann, Cresent Springs, KY (US); William A. Gallop, Westminster, MA (US)

(73) Assignee: Waddington North America, Inc., Chelmsford, MA (US)

( * ) Notice: Subject to any disclaimer, the term of this patent is extended or adjusted under 35 U.S.C. 154(b) by 241 days.

(21) Appl. No.: 12/652,483

(22) Filed: Jan. 5, 2010

(65) Prior Publication Data

US 2010/0170899 A1 Jul. 8, 2010

Related U.S. Application Data

(60) Provisional application No. 61/142,423, filed on Jan. 5, 2009.

(51) Int. Cl.
*B65D 41/18* (2006.01)

(52) U.S. Cl.
USPC ..... 220/793; 220/780; 220/4.21

(58) Field of Classification Search
USPC ..... 220/4.21, 780, 793
See application file for complete search history.

(56) References Cited

U.S. PATENT DOCUMENTS

| | | | |
|---|---|---|---|
| 236,266 | A | 1/1881 | Shirley |
| 622,564 | A | 4/1899 | Tebbetts |
| 1,034,636 | A | 8/1912 | McNair |
| D43,852 | S | 4/1913 | Sanford |
| D52,727 | S | 12/1918 | Beiswanger |
| 1,441,010 | A | 1/1923 | McGuire |
| D69,040 | S | 12/1925 | Loomis |
| D69,929 | S | 4/1926 | Zimmerman |
| 1,629,358 | A | 5/1927 | Padgett |
| D99,555 | S | 5/1936 | Smith |
| D124,290 | S | 12/1940 | Chaplin |
| 2,259,856 | A | 10/1941 | Moore |
| D164,407 | S | 9/1951 | Cowan |
| D174,832 | S | 5/1955 | Nowak |
| 3,047,179 | A | 7/1962 | Madej |

(Continued)

OTHER PUBLICATIONS

Cardinal Glassware, Arcoroc, Cardinal International, 30 Corporate Drive, Wayne, NJ 07470 (6 pages) pp. 84 and 85 of Catalog.

(Continued)

*Primary Examiner* — Anthony Stashick
*Assistant Examiner* — James N Smalley
(74) *Attorney, Agent, or Firm* — Maine Cernota & Rardin

(57) ABSTRACT

A lid is reliably engagable with a tray while being easily releasable without disturbing tray contents and without undue lid stress. At least two lift tabs or indentations are provided at separated locations about the lid periphery, thereby providing two distinct initial disengagement locations and overcoming any tendency of the elastic lid to reactively grip the tray when disengagement is initiated. Initial disengagement at the two locations thereby enables easy removal of the entire lid. Lid release can require simultaneous and/or sequential actuation of tabs and/or indentations. Embodiments further include locations that can be pressed while corresponding tabs are lifted. Some embodiments include a peripheral skirt that is short enough to allow a user's fingers to pass beneath and support the tray sidewalls when lifting the tray-lid assembly from a horizontal surface, avoiding any need for the lid engagement to bear the weight of the tray and its contents.

34 Claims, 11 Drawing Sheets

(56) References Cited

U.S. PATENT DOCUMENTS

| | | | | | |
|---|---|---|---|---|---|
| D195,699 | S | | 7/1963 | Bostrom | |
| 3,101,857 | A | | 8/1963 | Freedman | |
| 3,546,752 | A | | 12/1970 | Sargent | |
| 3,589,551 | A | | 6/1971 | Haggbom | |
| 3,688,942 | A | | 9/1972 | Mitchell et al. | |
| 3,707,240 | A | * | 12/1972 | Wilson | 215/256 |
| 3,889,842 | A | | 6/1975 | Bennett | |
| 4,049,187 | A | | 9/1977 | Florian | |
| 4,190,173 | A | | 2/1980 | Mason | |
| 4,241,855 | A | | 12/1980 | Yoshioka | |
| 4,331,255 | A | | 5/1982 | Fournier | |
| 4,494,672 | A | | 1/1985 | Pearson | |
| 4,589,569 | A | | 5/1986 | Clements | |
| 4,615,459 | A | | 10/1986 | Clements | |
| 4,619,372 | A | | 10/1986 | McFarland | |
| 4,620,665 | A | | 11/1986 | McSherry | |
| D287,207 | S | | 12/1986 | Daenen et al. | |
| 4,684,024 | A | | 8/1987 | Ebrahim et al. | |
| 4,687,117 | A | * | 8/1987 | Terauds | 220/781 |
| 4,721,210 | A | | 1/1988 | Lawrence et al. | |
| 4,753,365 | A | | 6/1988 | Seppala | |
| 4,782,975 | A | | 11/1988 | Coy | |
| 4,805,797 | A | * | 2/1989 | Natori | 220/784 |
| 4,874,083 | A | * | 10/1989 | Antoni et al. | 220/523 |
| 4,899,902 | A | | 2/1990 | Demars | |
| 4,986,438 | A | | 1/1991 | Borst | |
| 5,050,758 | A | | 9/1991 | Freeman et al. | |
| 5,054,640 | A | | 10/1991 | Tucker | |
| 5,076,333 | A | | 12/1991 | Law | |
| 5,125,525 | A | | 6/1992 | Tucker | |
| 5,143,248 | A | | 9/1992 | Sawatsky | |
| 5,203,467 | A | | 4/1993 | Tucker | |
| 5,203,490 | A | | 4/1993 | Roe | |
| 5,205,473 | A | | 4/1993 | Coffin, Sr. | |
| 5,222,656 | A | | 6/1993 | Carlson | |
| 5,240,132 | A | | 8/1993 | Tucker | |
| 5,253,780 | A | | 10/1993 | Adado | |
| 5,253,781 | A | | 10/1993 | Van Melle et al. | |
| D344,210 | S | | 2/1994 | Cousisn et al. | |
| D345,912 | S | | 4/1994 | Krupa | |
| D346,554 | S | | 5/1994 | Krupa | |
| 5,348,181 | A | | 9/1994 | Smith et al. | |
| D352,000 | S | | 11/1994 | Hansen et al. | |
| 5,363,978 | A | * | 11/1994 | Molo | 220/254.3 |
| D353,519 | S | | 12/1994 | Wolfenden | |
| 5,392,949 | A | | 2/1995 | McKenna | |
| 5,398,843 | A | | 3/1995 | Warden | |
| D358,091 | S | | 5/1995 | Warburton | |
| 5,425,497 | A | | 6/1995 | Sorensen | |
| D361,696 | S | | 8/1995 | Wolfenden | |
| 5,441,166 | A | * | 8/1995 | Lucas et al. | 220/782 |
| D364,090 | S | | 11/1995 | Krupa | |
| 5,490,609 | A | | 2/1996 | Lane et al. | |
| 5,538,154 | A | | 7/1996 | Von Holdt | |
| 5,538,157 | A | | 7/1996 | Proshan | |
| 5,540,350 | A | | 7/1996 | Lansky | |
| 5,542,670 | A | | 8/1996 | Morano | |
| 5,553,701 | A | * | 9/1996 | Jarecki et al. | 206/15.2 |
| D374,820 | S | | 10/1996 | Knoss et al. | |
| 5,579,949 | A | | 12/1996 | Dykes et al. | |
| 5,607,076 | A | | 3/1997 | Anthony | |
| 5,613,619 | A | | 3/1997 | Van Melle | |
| 5,613,720 | A | | 3/1997 | Shaddy | |
| 5,624,053 | A | | 4/1997 | Freek et al. | |
| 5,695,086 | A | * | 12/1997 | Viola | 220/287 |
| D391,479 | S | | 3/1998 | Poitras | |
| D391,850 | S | | 3/1998 | Krupa et al. | |
| 5,752,646 | A | | 5/1998 | Sandstrom | |
| 5,765,716 | A | | 6/1998 | Cai et al. | |
| 5,772,111 | A | | 6/1998 | Kirsch | |
| 5,820,016 | A | | 10/1998 | Stropkay | |
| 5,839,601 | A | | 11/1998 | Van Melle | |
| 5,894,952 | A | | 4/1999 | Mendenhall et al. | |
| D411,714 | S | | 6/1999 | Wilson et al. | |
| D413,487 | S | | 9/1999 | Vitali | |
| D414,413 | S | | 9/1999 | Brown | |
| 5,947,323 | A | | 9/1999 | Freek et al. | |
| D415,024 | S | | 10/1999 | McCann | |
| D415,025 | S | | 10/1999 | McCann | |
| 5,960,987 | A | | 10/1999 | Solland et al. | |
| D416,445 | S | | 11/1999 | Henry | |
| 5,979,689 | A | | 11/1999 | Lansky | |
| 5,979,697 | A | | 11/1999 | Kim | |
| D420,285 | S | | 2/2000 | Sagan et al. | |
| D420,854 | S | | 2/2000 | Michaeli | |
| D421,202 | S | | 2/2000 | Demers | |
| 6,089,397 | A | | 7/2000 | Van Melle | |
| D435,197 | S | | 12/2000 | Wellner | |
| 6,199,711 | B1 | | 3/2001 | Lansky | |
| 6,216,904 | B1 | | 4/2001 | Cagan | |
| 6,260,727 | B1 | | 7/2001 | Durdon | |
| 6,296,141 | B1 | | 10/2001 | Lukacevic | |
| 6,305,571 | B1 | | 10/2001 | Chu | |
| D450,537 | S | | 11/2001 | Hayes | |
| D450,538 | S | | 11/2001 | Benson | |
| 6,311,863 | B1 | | 11/2001 | Fleming | |
| 6,318,584 | B1 | | 11/2001 | Milan | |
| 6,325,236 | B1 | | 12/2001 | Wong | |
| D457,037 | S | | 5/2002 | Haynes | |
| 6,419,105 | B1 | | 7/2002 | Bruce et al. | |
| D461,678 | S | | 8/2002 | Haynes | |
| 6,488,173 | B2 | | 12/2002 | Milan | |
| 6,533,139 | B2 | | 3/2003 | Lukacevic | |
| 6,578,726 | B1 | | 6/2003 | Schaefer | |
| 6,612,456 | B1 | | 9/2003 | Hundley et al. | |
| 6,644,490 | B2 | | 11/2003 | Clarke | |
| 6,679,397 | B2 | | 1/2004 | Smith et al. | |
| 6,732,875 | B2 | | 5/2004 | Smith et al. | |
| 6,755,318 | B2 | | 6/2004 | Burke | |
| 6,811,049 | B2 | | 11/2004 | Lukacevic | |
| 6,874,649 | B2 | | 4/2005 | Clarke et al. | |
| 6,889,859 | B1 | | 5/2005 | Leon | |
| 6,889,860 | B2 | | 5/2005 | Mazzarolo | |
| 6,923,337 | B2 | | 8/2005 | Hession et al. | |
| 6,929,143 | B2 | | 8/2005 | Mazzarolo | |
| 7,032,773 | B2 | * | 4/2006 | Dees et al. | 220/793 |
| 7,063,224 | B2 | | 6/2006 | Clarke et al. | |
| 7,086,549 | B2 | | 8/2006 | Kosmyna et al. | |
| 7,100,790 | B2 | | 9/2006 | Dark | |
| 7,131,551 | B2 | | 11/2006 | Smith | |
| 7,134,566 | B2 | | 11/2006 | Smith et al. | |
| 7,134,570 | B1 | | 11/2006 | Heath et al. | |
| 7,156,251 | B2 | | 1/2007 | Smith et al. | |
| 7,246,715 | B2 | | 7/2007 | Smith | |
| 2002/0096530 | A1 | | 7/2002 | Waller | |
| 2003/0089713 | A1 | | 5/2003 | Belt et al. | |
| 2004/0232154 | A1 | | 11/2004 | Smith et al. | |
| 2005/0098581 | A1 | | 5/2005 | Long et al. | |
| 2005/0205587 | A1 | | 9/2005 | Sampson et al. | |
| 2006/0006184 | A1 | | 1/2006 | Bohman | |
| 2006/0096983 | A1 | | 5/2006 | Patterson | |
| 2006/0124645 | A1 | | 6/2006 | Peitersen | |
| 2007/0012710 | A1 | * | 1/2007 | Vovan | 220/793 |
| 2008/0011762 | A1 | | 1/2008 | Boone | |
| 2008/0156802 | A1 | | 7/2008 | Yauk et al. | |
| 2008/0156817 | A1 | | 7/2008 | Roseblade et al. | |
| 2009/0050641 | A1 | | 2/2009 | Ivey | |
| 2009/0065518 | A1 | | 3/2009 | Carnevali | |
| 2009/0108006 | A1 | | 4/2009 | Milan | |

OTHER PUBLICATIONS

Cardinal Glassware, Arcoroc, Cardinal International, 30 Corporate Drive, Wayne, NJ 07470 (6 pages) pp. 84 and 85 of Catalog, 2010.

* cited by examiner

LID FEATURING EASE OF USE AND IMPROVED RELEASE FROM A TRAY OR CONTAINER

RELATED APPLICATIONS

This application claims the benefit of U.S. Provisional Application No. 61/142,423 filed Jan. 5, 2009, incorporated herein by reference in its entirety for all purposes.

FIELD OF THE INVENTION

This invention relates generally to lids adapted for use with trays and containers, and more particularly to lids featuring ease of use and improved release from trays and containers.

BACKGROUND OF THE INVENTION

Containers with detachable and re-attachable lids, including disposable food containers, trays and platters with compatible lids, are well known and are commonly employed in many industries, including food related industries such as restaurants, caterers, institutional food service establishments, cafeterias, and households.

A tray, serving platter, or container base for use in catering and other food service applications frequently features a lid or cover that is cooperatively engagable therewith for presenting, handling, transporting, and/or protecting a variety of food items. The tray or base usually has an upwardly projecting sidewall terminating in a rim. The base or tray rim may simply feature a lip area, or may include sealing ridges, channels or other locking mechanisms that are adapted for cooperative engagement with corresponding grooves, inverted channels, or other cooperative features which are integrated with the lid. Note that the terms "tray" and "base" are used generically herein to refer to any type of tray, serving platter, container, or other support base which is attachable to a lid or cover. Note also that the term "lid" is used generically herein to refer to any type of lid or cover that is compatible with and attachable to a "tray" or a "base".

Most disposable lids for use with food containers and platters are usually thermoformed from a sheet of Polyethylene Terephthalate (PET) or Oriented Polystyrene (OPS) although other plastic materials may be employed. The lid is configured to fit the base, and may include an elevated and/or dome-shaped central portion to allow for comfortably accommodating a certain quantity or height of foods or other contents, and will preserve the shape, form, decorative appearance and/or the general presentation of items such as certain food preparations, including desserts, cakes, sandwiches, or other foods. Or the lid may be substantially flat, and may be attachable to a container which has sufficient depth to surround food items or other contents to be contained therein. In some approaches, once a lid has been engaged with a tray to form a first tray-lid assembly, a second tray-lid assembly can be stacked on top of the first tray-lid assembly, and thus a plurality of tray-lid assemblies can be stacked on top of each other for compact storage and for ease of transportation and handling.

In the case of food containment, it is paramount that food preparations be protected and that inadvertent disengagement or removal of the lid from the tray be avoided. Therefore, in many cases one or more locking features and/or undercuts are provided at the periphery of the tray and/or the lid, resulting in a relatively tight interference fit between the lid and the tray. However, this tight interference fit can make it difficult for a user to disengage and/or remove the lid at the time of use, resulting in an inconvenience to the user at best, and spilling of the food at worst, as the user struggles to remove the lid from the tray. Depending on the material from which the lid is constructed, the lid may even tear or rip during removal, thereby rendering subsequent reengagement of the lid with tray or container ineffective or futile.

A typical method for disengaging a generic container-lid assembly is by holding the container with one hand and pulling the lid off with the other hand. Sometimes a tab or an indent is provided in either the lid or the container so as to facilitate creating an initial separation or opening between the lid and the container at the location of the tab or indent, and then separating the lid from the container around the entire periphery of the container-lid assembly. However, this method of disengaging or separating a lid from a container can be difficult if the container is shallow, for example if the container is in the form of a tray or plate.

Typically, a lid having a raised portion, herein referred to generically as a "dome" lid regardless of whether the lid is round, rectangular, or some other shape, features a downwardly projecting peripheral skirt that overhangs beyond the perimeter of the tray or container base. As will be appreciate by those skilled in the art, for a relatively shallow tray the overhang of the peripheral skirt of the lid is typically almost as tall as the tray, making it difficult for a user to slide his or her fingers underneath the peripheral skirt of the lid for lifting the tray-lid assembly. Instead, a user typically has to lift the tray-lid assembly by the peripheral edge of the lid without touching the tray. In this situation, the entire weight of the tray and its contents is thus borne by the locking or engagement mechanism between the tray and the lid, further necessitating that the tray and lid have a tight fit, and making it even more difficult to removal the lid from the tray.

A particular difficulty for removing lids from tray-lid assemblies of the type described above is encountered due to the fact that in many cases the lid is flexible and the periphery of the tray-lid assembly is relatively large compared to the size of the tab or indent that is provided with the lid or the tray for initiating separation of the lid from the tray. Consequently, when a user exerts an upward or downward force on the tab or indent provided in the lid or tray for pulling the tray-lid assembly apart, the rim of the lid tends to press opposingly inwardly at other locations, causing the lid to grip even more tightly onto the tray at those locations, and thereby rendering removal of the dome from the tray base extremely difficult, or at least cumbersome.

Thus, there is a need for a lid that is securely engageable with a tray or a container and yet can be conveniently removed from the tray or container with relative ease and without disturbing the contents of the tray or container. These and other needs are met by the lid of the present invention.

BRIEF SUMMARY OF THE INVENTION

A lid is claimed for a tray that enables secure and reliable engagement between the lid and the tray while enabling easy removal of the lid from the tray without disturbing contents supported by the tray and without applying undue stress to the lid. In particular, the present invention enables removal of the lid from a tray-lid assembly in a reversible manner, i.e. without damaging the lid during removal.

Note that except where the context requires a more specific definition, the term "tray" is used herein to refer generically to a tray, platter, dish, container, plate, or any other support base compatible with a lid or cover, and the term "lid" is used generically herein to refer to any sort of lid or cover compatible with a "tray," including flat lids and "dome" lids that include raised portions so as to have cross sectional profiles that are rectangular, rounded, or any other raised shape.

Note also that while the following discussion is presented in the context of describing feature(s) of a lid, whereby the feature(s) enable removal of the lid from a tray, the roles of the lid and the tray can be reversed without departing from the scope of the invention. In other words, a specific feature or features ascribed herein to the "lid" (or upper element) can be incorporated into the "tray" (or lower element) of the tray-lid combination. Therefore, the invention applies generally to separable halves of a containing assembly comprising a first half and a second half, whereby terms used for convenience to describe one half of the containing assembly, such as "lid" and "cover," can generally be exchanged herein with terms used to describe the other half of the containing assembly, such as "tray," "container," and "support base," without departing from the meaning or scope of the invention.

The claimed lid facilitates separation of the lid from the tray-lid assembly by providing at least two tabs or indentations at two separate locations on the outer periphery of the lid, thereby providing at least two distinct locations for initial disengagement of the lid from the tray. By disengaging the lid from the tray at two or more separated locations about the rim, the tendency of the elastic lid to responsively grip the tray is overcome, and the lid is released from the tray without the user applying undue effort, without subjecting the lid to undue stress, and without unduly disturbing the contents of the tray-lid assembly.

An additional feature of the present invention is to facilitate lifting of a tray-lid assembly securely from a flat surface by utilizing a lid construction with a peripheral skirt that is short enough to allow a user's fingers to reach underneath the skirt and support the sidewalls of the tray when lifting and/or carrying the tray-lid assembly, so that the entire weight of the tray-lid assembly, including any contents supported thereby, is not exclusively borne by the cooperative engagement features.

Still another feature of the present invention is to provide a lid having a peripheral flange and a peripheral skirt, wherein the peripheral flange has at least a first pressing area and a second pressing area, and wherein the peripheral skirt has a first lifting tab and a second lifting tab. The first pressing area works cooperatively with the first lifting tab and the second pressing area works cooperatively with the second lifting tab. During the process of removing the lid from the tray, a user presses the first pressing area and lifts the first lifting tab with one hand, and concurrently presses the second pressing area and lifts the second lifting tab with the second hand. Once at least a partial separation has been created at the first and second lifting tab locations, the entire lid can be readily removed from the tray.

The features and advantages described herein are not all-inclusive and, in particular, many additional features and advantages will be apparent to one of ordinary skill in the art in view of the drawings, specification, and examples of claims. Moreover, it should be noted that the language used in the specification has been principally selected for readability and instructional purposes, and not to limit the scope of the inventive subject matter.

BRIEF DESCRIPTION OF THE DRAWINGS

The invention will be better understood upon reading the following Detailed Description in conjunction with the drawings in which.

DETAILED DESCRIPTION OF THE INVENTION

The present invention is generally directed towards a lid that can be securely engaged with a tray or container base and yet is readily removable without unduly disturbing the contents of the tray-lid assembly and without applying undue stress to the lid. The following description of one or more embodiments, in conjunction with the accompanying drawings, are offered by way of illustration only, and should not be regarded as restricting the scope of the invention.

Note that except where the context requires a more specific definition, the term "tray" is used herein to refer generically to a tray, platter, dish, container, plate, or any other support base compatible with a lid or cover, and the term "lid" is used generically herein to refer to any sort of lid or cover compatible with a tray, including flat lids and "dome" lids that are round, rectangular, or any other shape.

Note also that while the discussion that follows is presented in the context of describing features of a lid that enable removal of the lid from a tray, the roles of the lid and the tray can be reversed without departing from the scope of the invention, so that the features ascribed herein to the "lid" (or upper element) can be incorporated into the "tray" (or lower element) of the tray-lid combination. Therefore, the invention applies generally to separable halves of a containing assembly, whereby terms used for convenience to describe one half of the containing assembly, such as "lid" and "cover," can generally be exchanged herein with terms used to describe the other half of the containing assembly, such as "tray," "container," and "support base," without departing from the meaning or scope of the invention.

As will become readily apparent from the foregoing description, a lid that is easy to use and can be readily removed without damaging the lid according to the present invention provides several advantages over prior art lids and tray-lid assemblies. In the case of a food-containing tray-lid assembly, the present invention enables a user to comfortably remove the lid from a tray or other container base with relative ease and without unduly disturbing any of the food items contained within the tray-lid assembly. In particular, the release features or mechanism of the present invention enables lid removal without use of excessive force, which could otherwise result in tearing or damaging of the lid during removal. Being undamaged, the lid can be reattached to the tray and reused as needed.

Figure 1A:
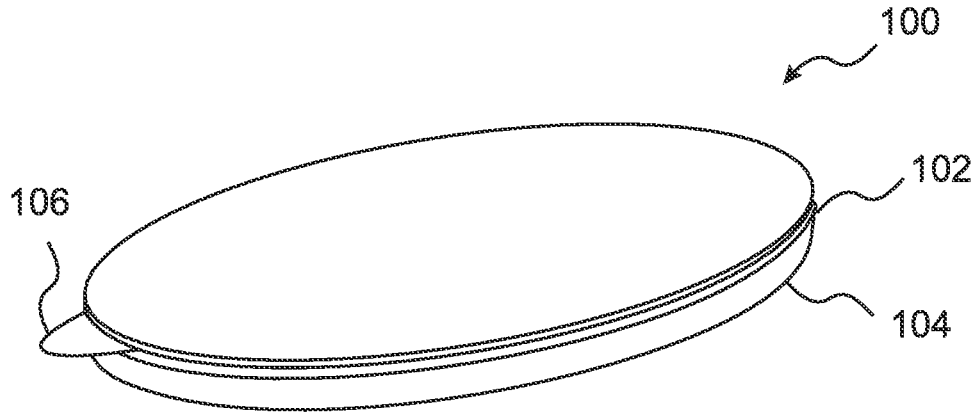
Figure 1A Prior Art
FIG. 1A is a perspective view of a simple lid of the prior art having a single lift tab.
Figure 1B:
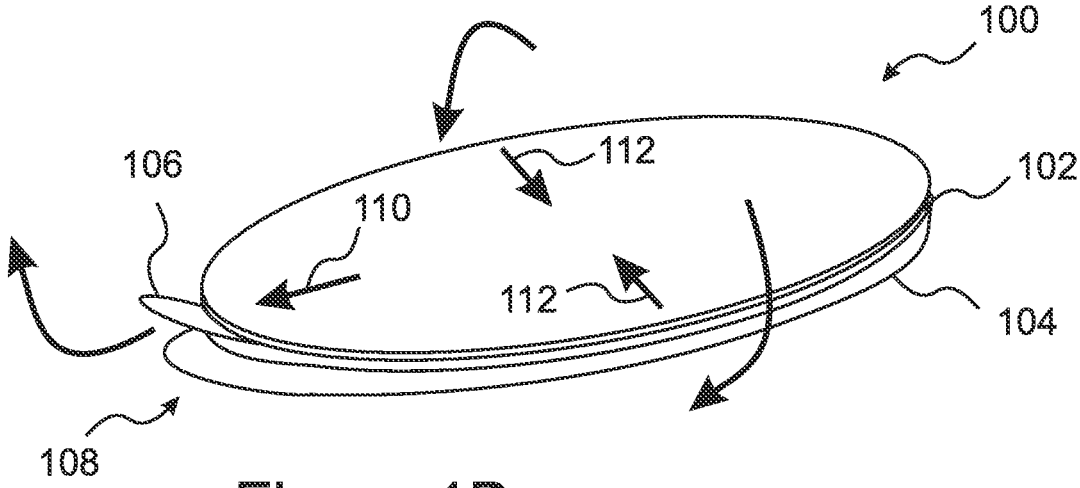
Figure 1B Prior Art
FIG. 1B is a perspective view of the simple lid of FIG. 1A, illustrating lifting of a single lift tab and consequent opposing inward distortion of the lid that grips the tray and hinders release of the tray from the lid.

FIG. 1A illustrates a simple lid 100 of the prior art. Lid 100 includes a groove 102 into which a lip of a tray (not shown) can be inserted for secure engagement therewith. Lid 100 also includes a skirt 104 that extends downwardly from the groove 102. A tab 106 is provided in an attempt to facilitate removal of lid 100 from a tray. As illustrated in FIG. 1B, lifting of the tab 106 causes an initial separation between the groove 102 and the rim of the tray in a region 108 immediately proximal to the tab 106. However, lifting the tab 106 also necessarily leads to an outwardly radial elongation 110 of the groove 102 toward the tab 106, and consequently orthogonal, inwardly radial forces 112 on opposing sides of the groove 102. These opposing, inwardly radial forces 112 cause the groove 102 to be tightly pressed toward the rim of the tray as the tab 106 is lifted, thereby causing removal of the lid 100 to be very difficult. In the resulting struggle to overcome this gripping force 112, food or other contents of the tray-lid assembly can be disturbed, and in extreme cases the lid material can fail and the lid 100 can be damaged.

A lid designated by reference numeral 10, according to an embodiment of the present invention, is shown in FIGS. 2 through 6, wherein like reference numerals represent like parts. Lid 10 is adapted for engaging with a tray or container base, and as particularly shown in FIG. 6, lid 10 is shown in a superjacent relationship with tray 30 and is engaged therewith.

In FIGS. 2 through 6, lid 10 is shown with a plurality of ornamental design features, however, it will be apparent to those skilled in the art that the utilitarian structural features of the present invention can be readily utilized with or without a variety of aesthetic and/or ornamental lid designs, and that the features of the present invention are not limited to a particular lid style or design. Thus, variations in the lid sidewall and top wall are within the scope of the present invention, and do not affect the ease of use and release functionality described herein. Additionally, the height of the lid 10 is shorter or taller in certain embodiments, and/or the lid sidewall in some embodiments includes upright ribs and/or the lid top wall includes a combination of structural features, including a shape other than a flat top, such as a rounded shape.

Figure 2:
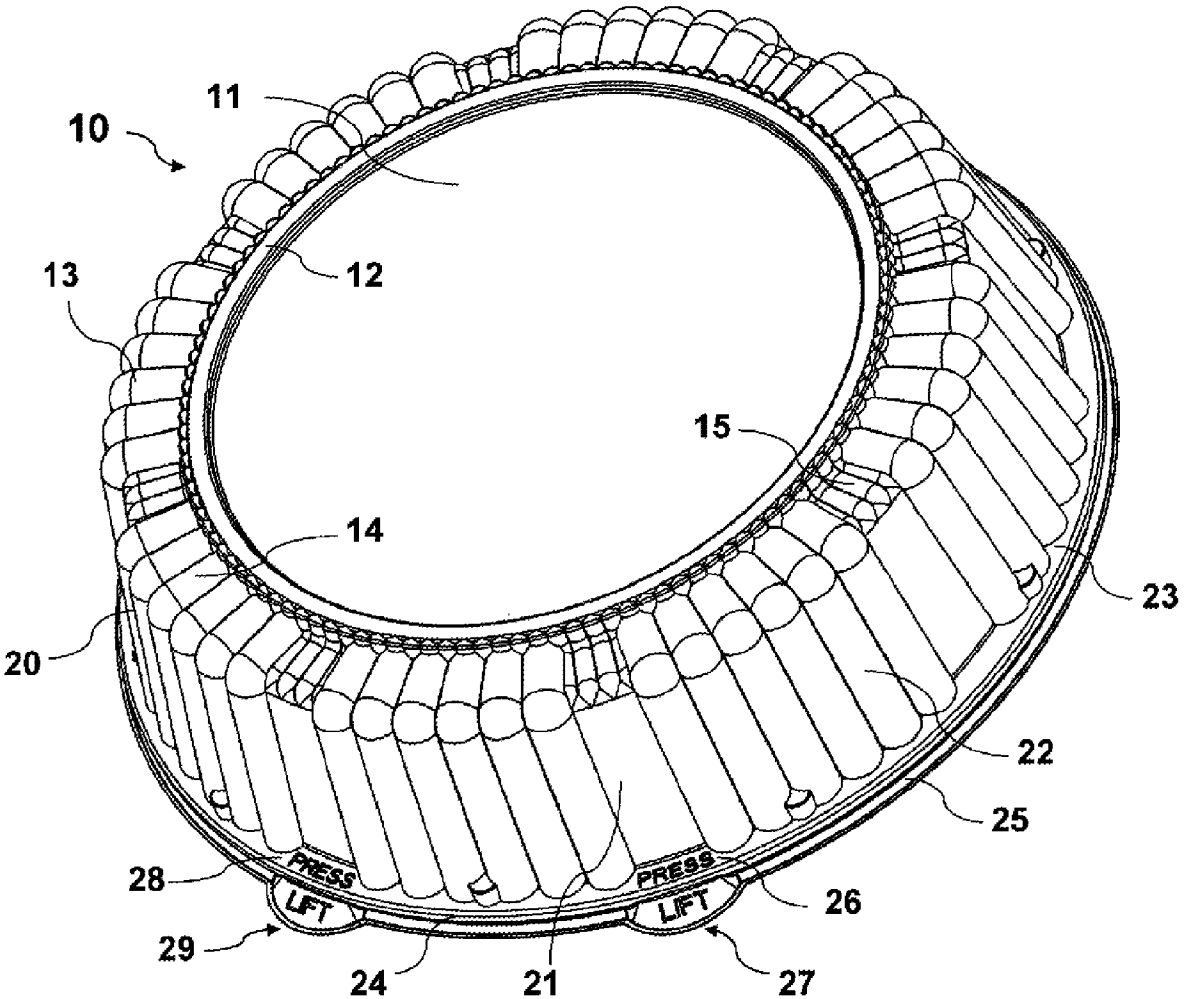
FIG. 2 is a perspective view of a dome lid according to an embodiment of the present invention.
Figure 3:
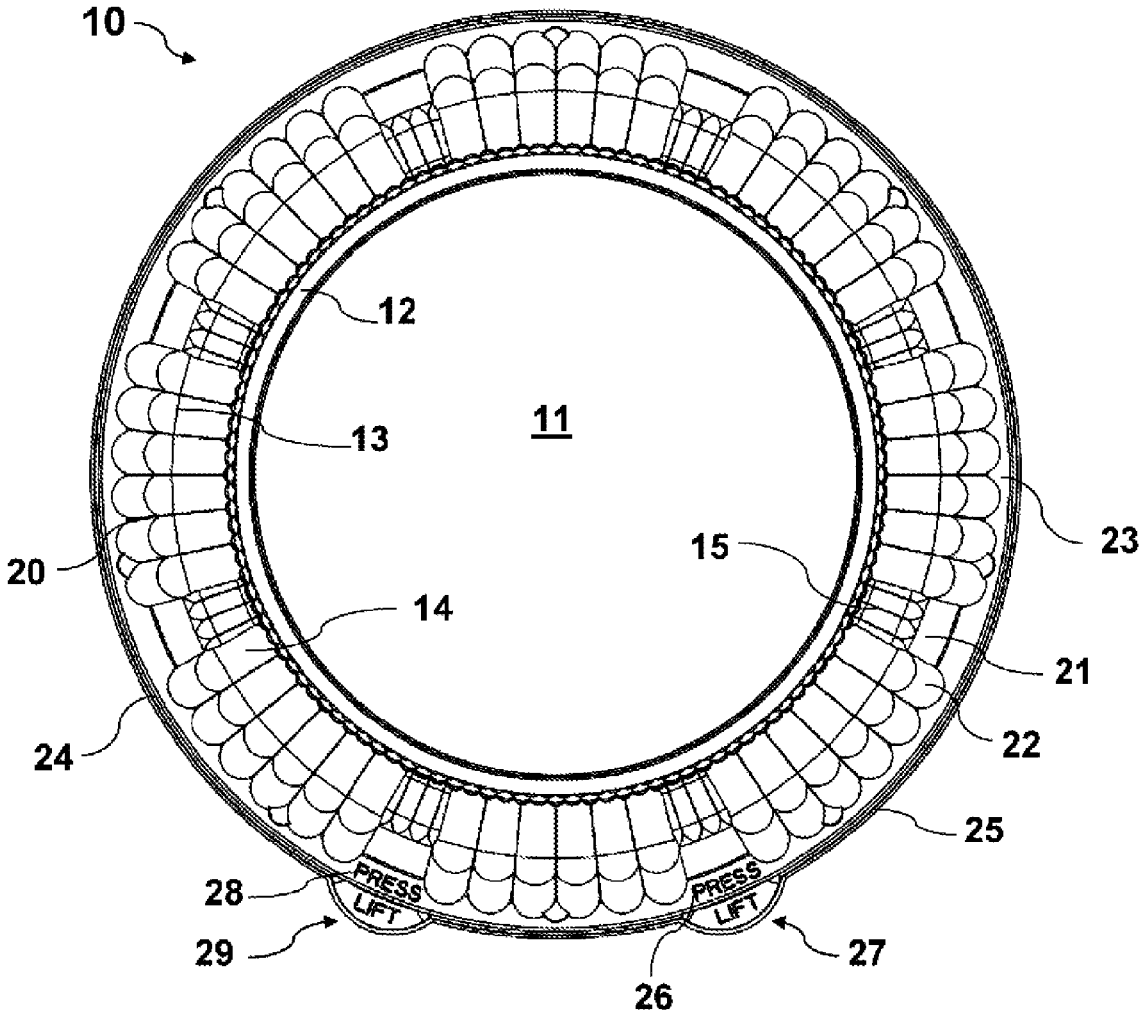
FIG. 3 is a top view of the lid of FIG. 2.

As shown in FIG. 2, the container lid 10 of the illustrated embodiment integrally comprises a generally planar central top wall 11; a raised shoulder portion 12 circumscribing or encircling top wall 11; a peripheral top portion 13 circumscribing raised shoulder portion 12; a sidewall 20 extending circumferentially downward from said peripheral top portion 13; a peripheral flange 23 extending outwardly from the bottom end of sidewall 20; a peripheral groove portion 24; and a downwardly projecting peripheral skirt 25.

In the embodiment shown in FIGS. 2-6, central top wall 11 is generally planar and substantially horizontal as shown, and is adapted to allow a user to view the contents of the tray-lid assembly. In other embodiments, the lid is opaque or translucent, and/or has a rounded or other non-planar shape or appearance.

In the embodiment shown in FIGS. 2-6, the raised shoulder portion 12 of lid 10 is adapted for facilitating stacking of another tray-lid assembly on top of lid 10, whereby nesting of the raised shoulder 12 into a recess provided in the bottom of a second tray stacked above the lid 10 serves to stabilize the stacked assembly (or assemblies) and prevent sliding thereof during transportation or while handling and carrying a plurality of stacked assemblies.

Figure 4:
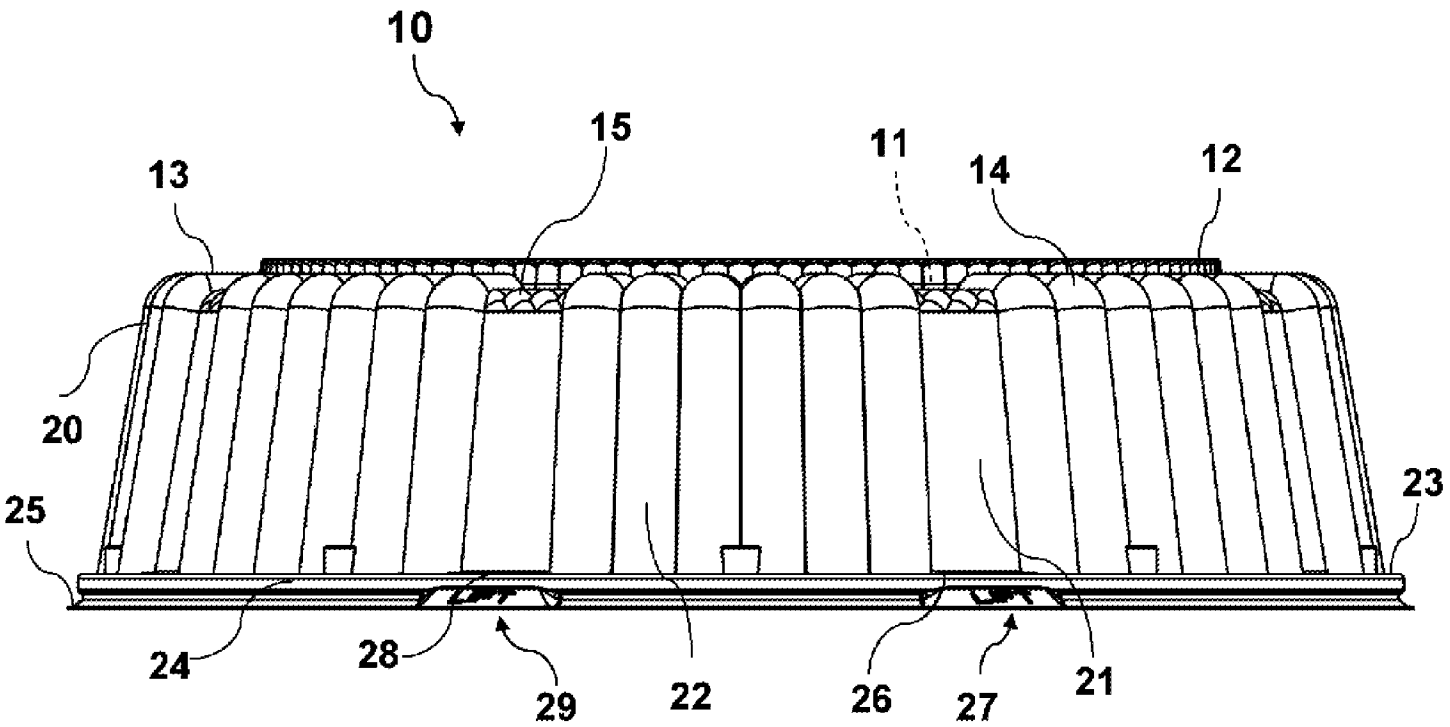
FIG. 4 is a side view of the lid of FIG. 2.
Figure 9A:
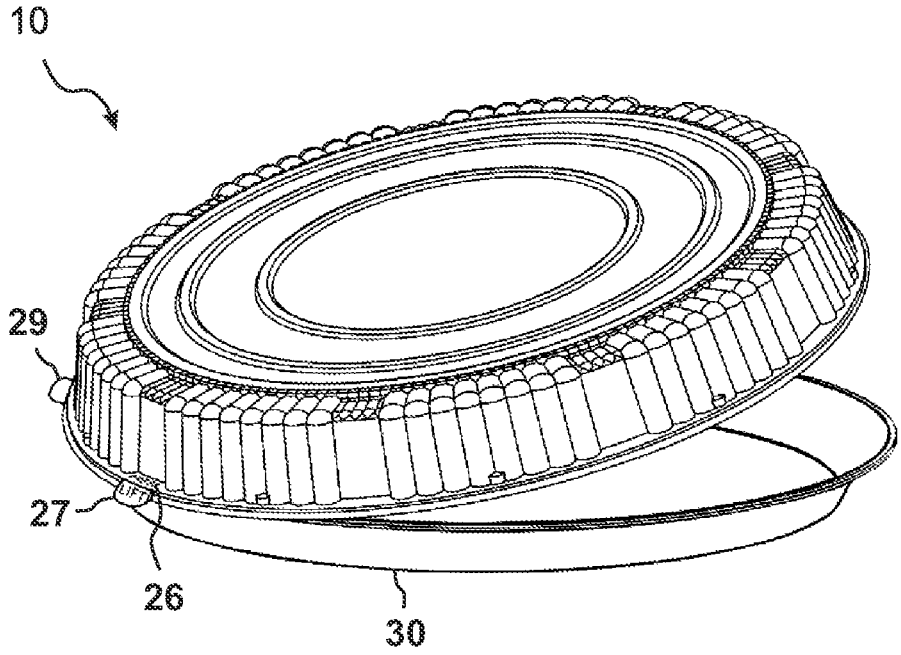
FIG. 9A is a perspective view of the dome lid of FIG. 8 having its lift tabs engaged with the tray and prepared for full engagement of the dome lid with the tray.
Figure 9B:
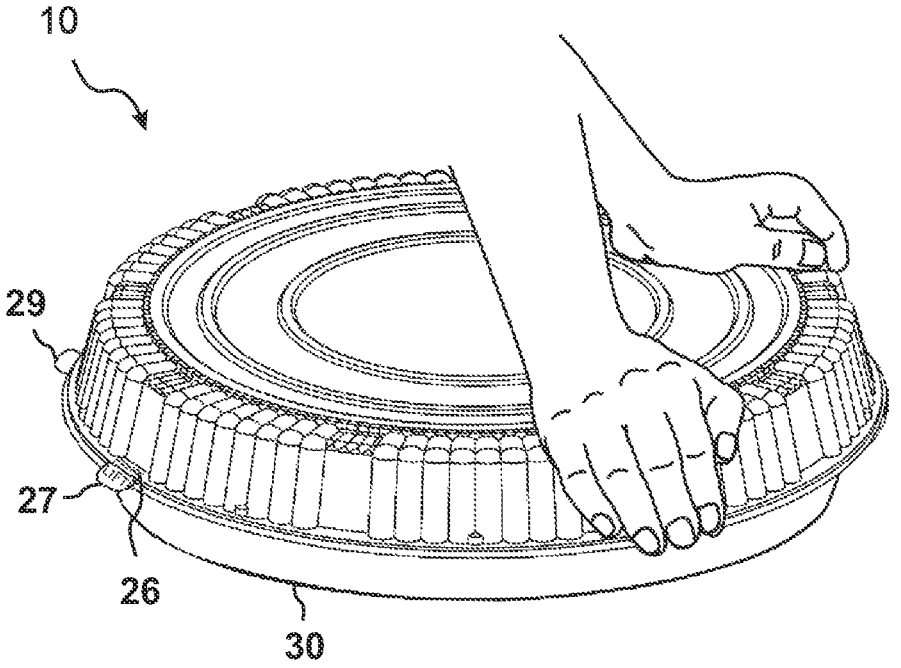
FIG. 9B is a perspective view of the dome lid and tray of FIG. 9A showing pressure being applied to the dome lid so as to attach the dome lid to the tray.

As shown, peripheral top portion 13 may include a variety of ornamental features which also serve as structural stiffening members that strengthen the lid, so that the peripheral top portion 13 can retain its dimensional stability against a downward force typically applied thereto during assembly of lid 10 with a tray or container (see FIG. 9), and when supporting the weight of another tray-lid assembly. In the exemplary embodiment illustrated herein in FIGS. 2-6, peripheral top portion 13 features a plurality of flutes 14 and a plurality of ribs 15. In the illustrated embodiment, the flutes 14 and ribs 15 are organized in sections that form an alternately repeating pattern circumferentially arranged around raised shoulder portion 12. As is best shown in FIGS. 2 and 4, the flutes 14 have an upwardly raised or convex geometry. However it will be appreciated by those skilled in the art that a variety of designs, geometries, patterns and/or other structural elements may be readily imparted to or included in embodiments of the lid of the present invention so as to provide aesthetic appeal and/or structural reinforcement.

As is best shown in FIG. 4, sidewall 20 extends downwardly from peripheral top portion 13 and tapers radially outwardly so as to provide a gradual draft angle for ease of processing and so as to facilitate mold release during the thermoforming process or during any other processing method used for manufacturing lid 10. Sidewall 20 includes a plurality of panels 21 and flutes 22 that are circumferentially arranged in an alternately repeating pattern therein. The bottom end of sidewall 20 is connected to peripheral flange 23 which is generally horizontal in the embodiment of FIGS. 2-6.

Based on the views shown in various figures herein, it should be readily apparent that relative terms such as "horizontal" are used only for illustrative purposes in describing embodiments of the invention, and that more general terms such as "planar" can be substituted without departing from the scope of the invention. Furthermore modifiers such as 'generally' and 'substantially' are intended to be construed liberally. Thus, for example, 'generally planar' and 'substantially planar' are intended to allow for irregular deviations from perfectly flat surface and to reasonably broaden terms such as "planar" so as to encompass curved and other non-planar surfaces.

Figure 6:
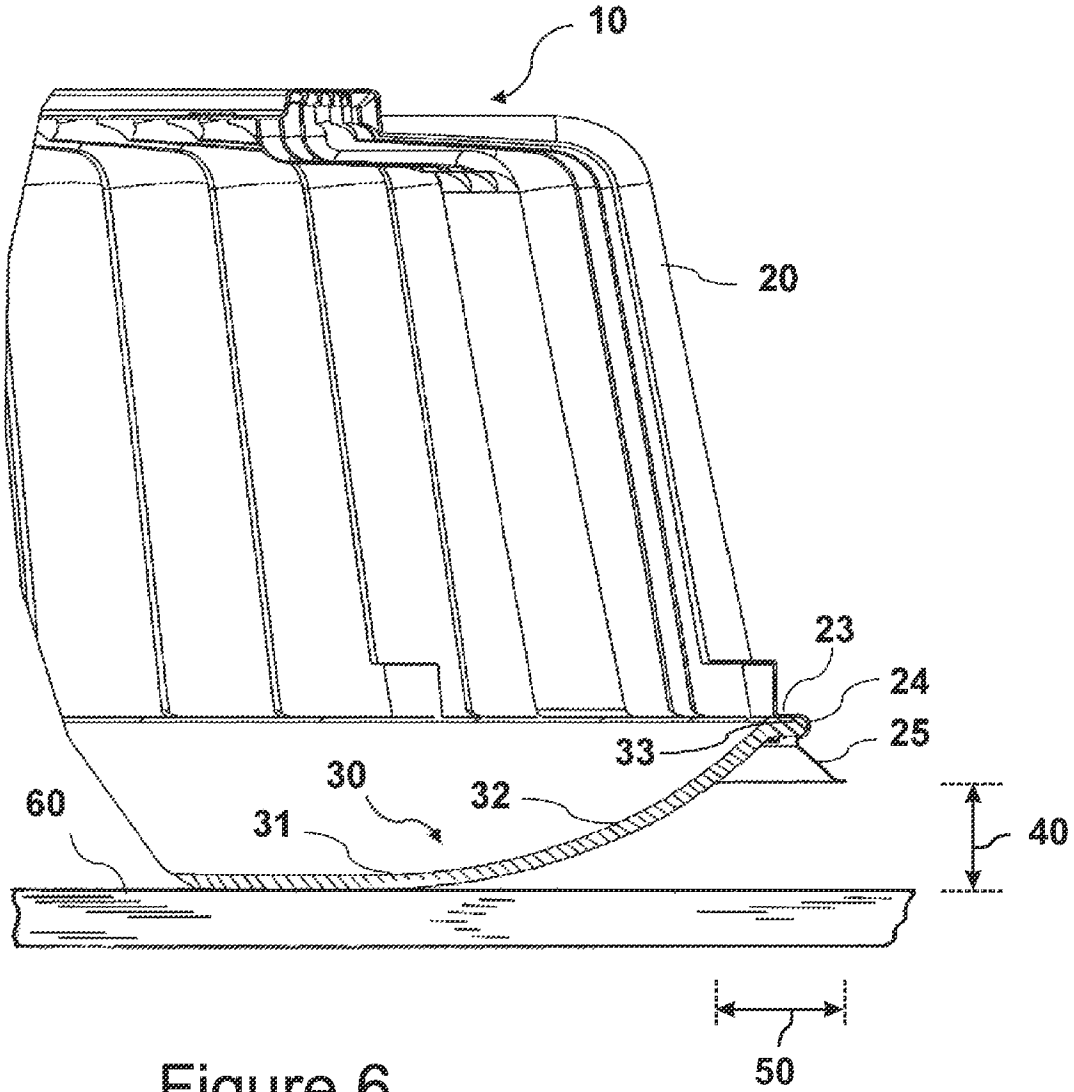
FIG. 6 is a partial cutaway view of a tray-lid assembly according to an embodiment of the invention wherein the lid displays a short peripheral skirt.

As is best shown in FIGS. 4 and 6, peripheral flange 23 rolls downwardly to define a peripheral groove portion 24. Peripheral groove portion 24 has a C-shaped or U-shaped cross section which is adapted for engaging with a tray by receiving a tray lip therein. Referring to FIG. 6, there is shown a cross-sectional view of a tray 30 attached to lid 10. Tray 30 comprises a tray bottom wall 31 resting on a generally horizontal table surface 60, a tray sidewall 32 which extends upwardly and outwardly from the tray bottom wall 31, and a peripheral tray lip 33. In the embodiment of FIG. 6, the peripheral tray lip 33 has a bead-like configuration. In other embodiments, the tray lip includes other features, such as a turned-down configuration (not shown). As shown in FIG. 6, peripheral tray lip 33 nests within the peripheral groove portion 24 of lid 10, and the slight undercut in the groove portion 24 provides a reasonably secure interference fit between the lid 10 and the tray 30.

Lid 10 also features a peripheral skirt 25 which extends downwardly from the underside of the peripheral groove portion 24 and flares radially outwardly. Peripheral skirt 25 facilitates a good lid-fit by guiding the tray lip 33 within the peripheral groove portion 24.

As mentioned above, the present invention provides ease of use and release functionality. The release functionality is accomplished by means of at least two lift tabs provided in the peripheral skirt. Accordingly, in the embodiment of FIGS. 2-6, lift tabs 27 and 29 are provided in the tray skirt 25. Lift tab 27 is adapted to work cooperatively with press area 26. Lift tab 29 is adapted to work cooperatively with press area 28. Press areas 27 and 28 lie in the peripheral flange 23 proximate to panels 21.

Figure 7:
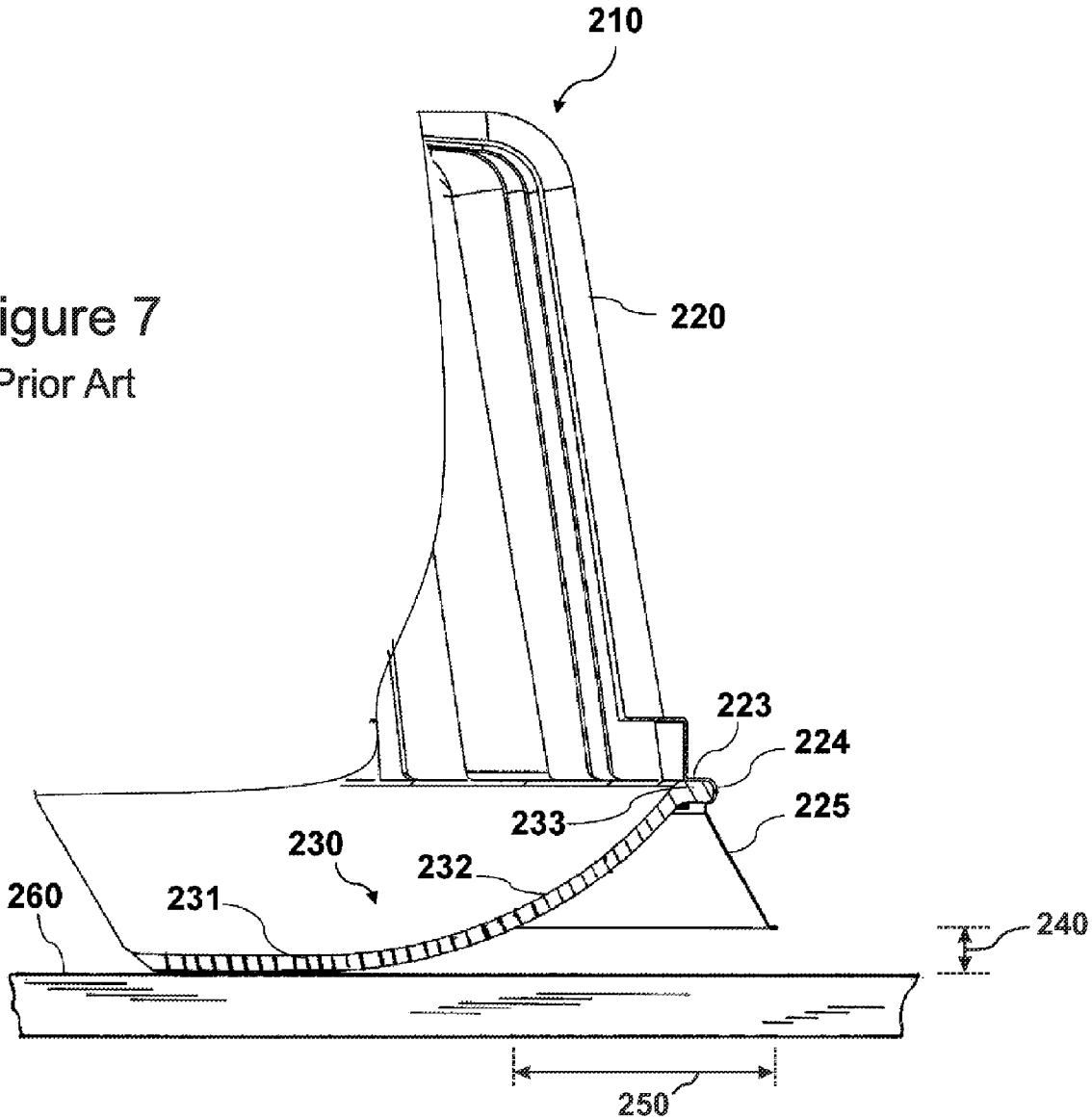
Figure 7 Prior Art
FIG. 7 is a partial cutaway view of a tray-lid assembly wherein the lid displays a relatively tall peripheral skirt as typically utilized in dome lids of the prior art.
Figure 8:
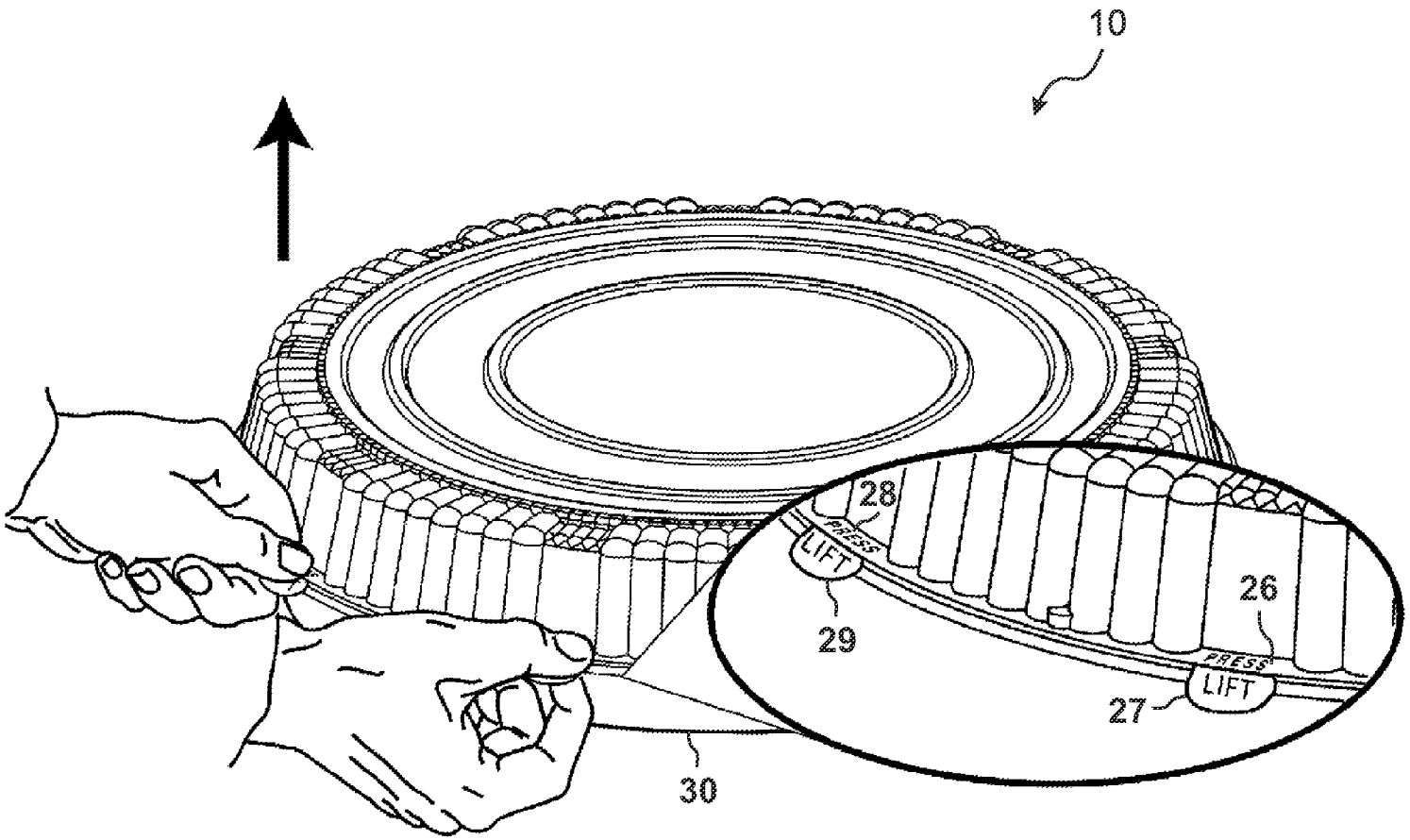
FIG. 8 is a perspective view of a user removing a dome lid from a tray with both hands according to an embodiment of the present invention.

A typical method of removing the lid 10 of the embodiment of FIG. 6 from the tray 30 will now be described. With reference to FIG. 8, during removal of the lid from the tray, a user presses on press area 26 and lifts lift tab 27 with one hand, and concurrently presses on press area 28 and lifts lift tab 29 with the second hand. The lifting action with both hands serves to rotate the tabs upwardly thereby disengaging a sufficient peripheral portion of lid 10 from the peripheral tray lip of the cooperatively engaged tray or container base to allow removal of the entire lid from the tray. The region of initial disengagement extends peripherally away from each point of lifting action in both directions, and may or may not extend continuously between the two points of lifting action. The removal of the lid of the present invention from a tray by a user is graphically shown in FIG. 9. As is best shown in FIGS. 1, 2, 4, and 7, press areas may be indicated by integrally forming or molding the word "PRESS" therein, and lift tabs may be indicated by integrally forming or molding the word "LIFT" therein for the purposes of providing simple lid removal instructions to a user.

Figure 10:
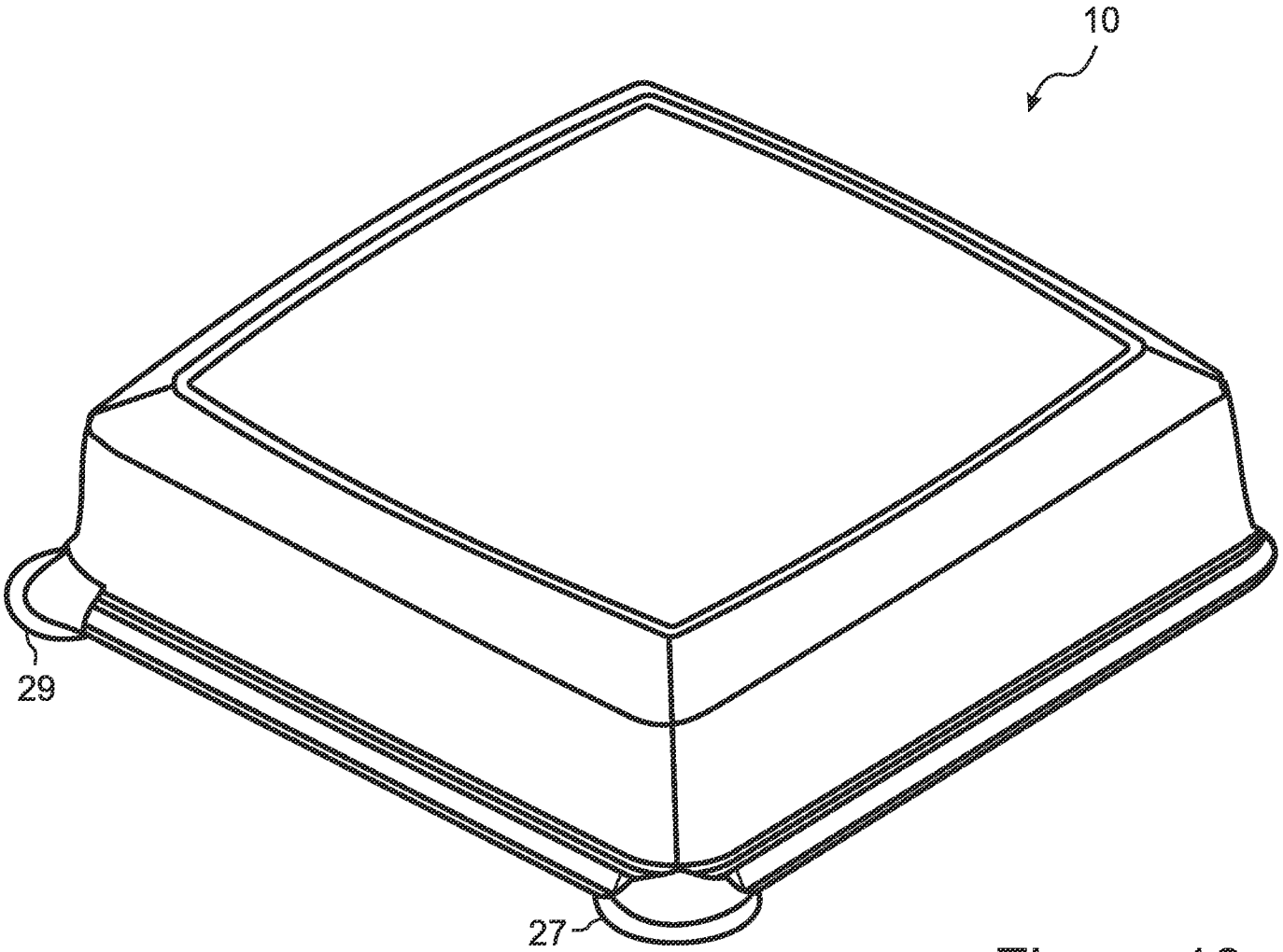
FIG. 10 is a perspective view of a square dome lid with lift tabs at two corners according to an embodiment of the present invention.
Figure 11:
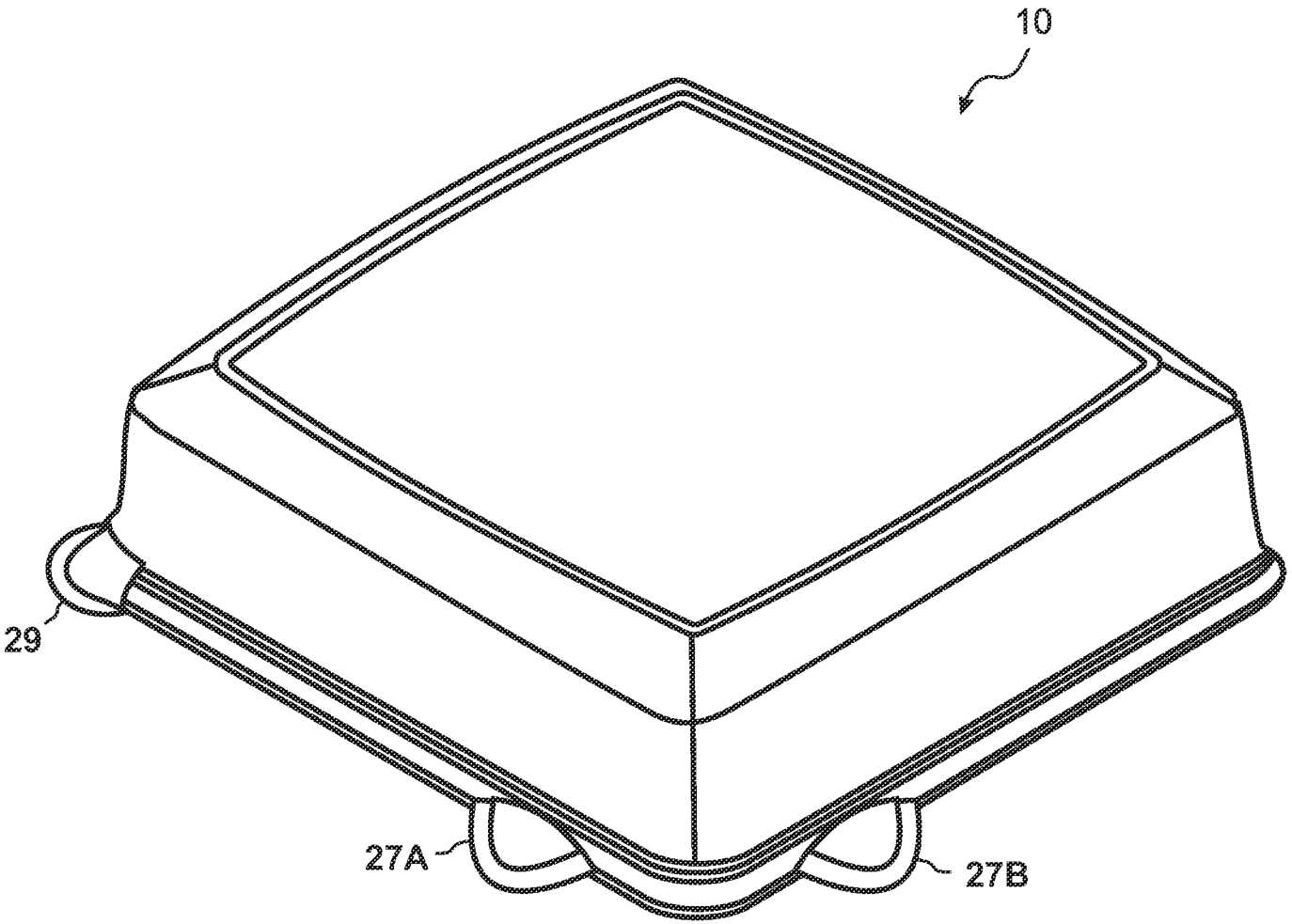
FIG. 11 is a perspective view of a square lid having two lift tabs located on either side of a corner and one additional lift tab located at an adjacent corner, according to an embodiment of the present invention.

Since lift tabs 27 and 29 lie along the peripheral skirt 25, the arcuate distance between lift tab 27 and 29 can be optimized for allowing a user to comfortably grip the respective tabs with both hands and for providing a convenient release from the tray. According to some embodiments of the invention, the arc angle between lift tabs 27 and 29 varies from 20 to 60 degrees, and according to some embodiments of the invention the arc angle between the lift tabs is between 25 to 50 degrees. Polygon-shaped trays and lids can have lift tabs located at two or more adjacent corners, as illustrated in FIG. 10. In other embodiments, two lift tabs are located on either side of one corner, as shown in FIG. 11. Various embodiments that include more than two lift tabs, for example on larger trays and lids, may require sequentially applied lifting actions by which suitable peripheral portions of the lid are disengaged from the tray. It is will be appreciated by those of ordinary skill that removing the lid of the present invention with one hand by using a single lift tab is significantly more cumbersome compared to utilizing two of the lift tabs concurrently, or more than two sequentially, for removing the lid from the tray.

Figure 5:
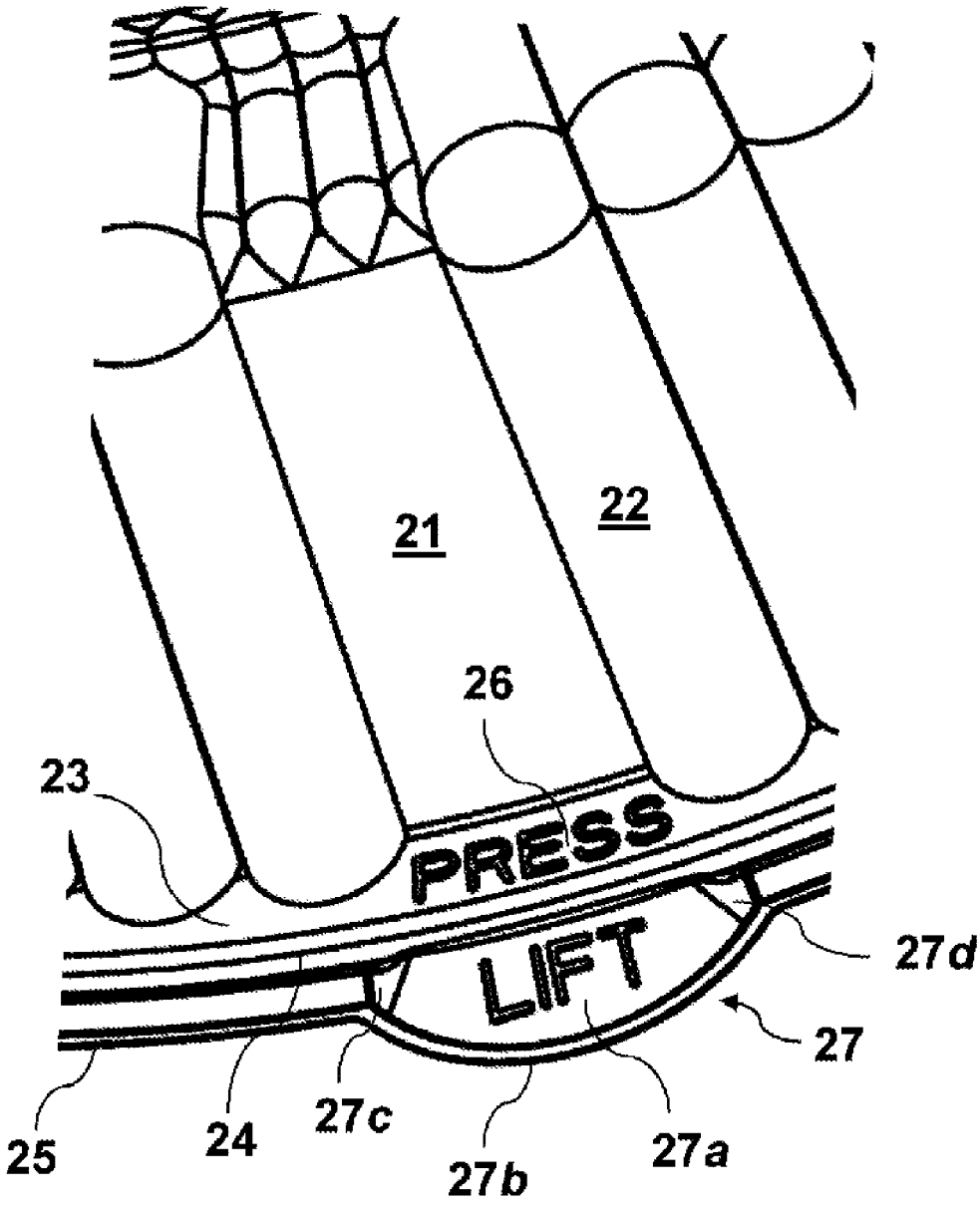
FIG. 5 is an enlarged view of a press area and lift tab of the lid of FIG. 2.

FIG. 5 shows an enlarged view of one of the lift tabs, particularly lift tab 27. Lift tab 27 features a front wall 27*a*, an arcuate front end 27*b*, and a pair of wedge-shaped side ends 27*c* and 27*d*. Front wall 27*a* may be curved outwardly to allow lifting or flexibly turning or rotating of the tab 27 upward, and thereby locally disengaging the peripheral groove portion 24 from tray 30. Local disengagement of peripheral groove portion 24 from tray 30 at both tab locations 27 and 29 sufficiently disturbs the lid engagement to allow an easy removal of the lid from the tray or container base. It will be realized that tabs 27 and 29 can feature a variety of shape configurations which are all deemed within the scope of the invention, including rectangular, button-shaped, or other structural shapes and appearances.

According to an embodiment of the invention, the peripheral groove portion 24 and lift tabs 27 and 29 are adapted for detachably engaging and fitting lid 10 with a tray or container base 30. Accordingly lid 10 is constructed of suitable materials to allow engagement and subsequent reengagement if desired by the user.

It will be apparent to those skilled in the art that the lids of the present invention can be made of a suitable thermoplastic material which can be processed by common polymer processing methods known in the art, such as thermoforming or injection molding. The choice of a thermoplastic resin is typically governed by a variety of factors, including cost, resin processability, and other functional requirements of the lid. Accordingly, lids of the present invention can be manufactured by thermoforming and/or injection molding. In some embodiments of the present invention, the lid is thermoformed from a polyethylene terephthalate (PET) sheet material. According to other embodiments of the present invention, the lid is injection molded from a suitable grade of polypropylene resin.

Certain embodiments of the present invention also include a low profile or short peripheral skirt. As shown in FIG. 6, arrow segment 40 indicates the vertical spacing between the bottom of peripheral skirt 25 and the table surface 60, and arrow segment 50 indicates the horizontal spacing between the outer edge of peripheral skirt 25 and tray sidewall 32. The advantages will be better understood by contrasting the peripheral skirt 25 according to the embodiment of FIG. 5 with the construction of a prior art lid. FIG. 7 illustrates a lid 210 according to the prior art fitted onto tray 230. The peripheral skirt 225 of lid 210 is appreciably longer than peripheral skirt 25 of lid 10. The longer length of peripheral skirt 225 results in a much reduced spacing, indicated by arrow segment 240, between the table surface 260 and peripheral skirt 225. This poses an inconvenience to the user when lifting the tray-lid assembly represented by tray 230 and lid 210. Furthermore, the horizontal distance between the outer edge of peripheral skirt 225 and the tray sidewall 232 represented by arrow segment 250 is also too large for a user to conveniently reach the tray with his or her fingers when lifting the tray-lid assembly, thus requiring the fit between the tray and lid to be sufficiently tight for the tray-lid engagement feature to support the entire weight of the assembly and of any items contained therein. However, in some embodiments of the present invention, the distance between the tray sidewall 32 and the outer peripheral skirt 25 represented by arrow segment 50 is sufficiently short to conveniently allow a user to lift the tray-lid assembly while touching and supporting the tray, thereby reducing the stress or weight felt by the tray-lid engagement features. In addition, allowing a user to hold the tray-lid assembly more securely without relying on just the tray-lid engagement and/or interlocking features also provides ease of use and safety.

The dual tab feature described above is not limited to round lids, but can be implemented on lids of any shape, including rectangular and square lids. A square lid 10 with two corner tabs 27, 29 according to an embodiment of the present invention is shown in FIG. 10. It will be realized that the positions of the two or more tabs can be optimized to provide ease of release on square and rectangular lids. According to another exemplary embodiment of the invention illustrated in FIG. 11, the two tabs 27A, 27B are located in a proximate relationship about a bottom corner of a square or rectangular lid 10 and are disposed in a slightly offset position from that corner on both sides thereof. In addition, FIG. 11 shows a third lift tab 29 at an adjacent corner. Dual or multiple tabs can thus also be implemented on lids having a general shape such as a polygonal shape. Thus, the exemplary embodiments shown in FIG. 10 and FIG. 11 are illustrative of embodiments of the invention for non-round containers and do not limit the scope of the invention with regards to lid shape and locations of tabs.

The embodiments discussed above all include lids that incorporate lift tab features of the present invention for facilitating separation of a lid from a tray. However, it will be understood by anyone skilled in the art that the same purpose can be accomplished by providing indentation features or recessed locations in the tray for allowing access to a user's hands for grasping and manipulating the lid periphery. Therefore, the graspable tabs can be created by indentations provided in either the tray or the lid. Furthermore, graspable members for manipulating separation of a tray-lid assembly may be configured in the form of lift tabs, push tabs, indentations, or combinations thereof. In addition, it will be understood by those skilled in the art that the features of the present invention can be included in the lower, or "tray" portion of a tray-lid assembly, rather than in the lid.

The foregoing description of the embodiments of the invention has been presented for the purposes of illustration and description. It is not intended to be exhaustive or to limit the invention to the precise form disclosed. Accordingly, the drawing and description are to be regarded as illustrative in nature, and not as restrictive. Many modifications and variations are possible in light of this disclosure. The advantages of the invention may be further realized and attained by means of the instrumentalities and combinations particularly pointed out in the appended example of claims.

What is claimed is:

1. A lid adapted for engagement with a container base and easy release therefrom, the lid and container base comprising:

a container base having a container bottom wall, a container sidewall that extends upwardly and outwardly from said container bottom wall, and a peripheral container lip that is substantially round;

a lid having a lid top and a lid engagement feature proximal to a peripheral boundary of the lid, said peripheral boundary of the lid being substantially round, said lid engagement feature comprising a peripheral groove extending substantially annularly about the peripheral boundary, said peripheral groove being configured for mutual cooperation and attachment with the container base by receiving said peripheral container lip of the container base therein, thereby allowing formation of a base-lid assembly;

a peripheral skirt extending downwardly and flaring outwardly from said peripheral groove, said peripheral skirt being located below said peripheral container lip when said container base and said lid are engaged to form said base-lid assembly; and a pair of graspable members provided in said peripheral skirt of the lid in locations that are not directly opposite to each other, said graspable members being configured for grasping and flexing the peripheral skirt and disengaging the peripheral groove from the peripheral container lip at two locations, from which said disengagement propagates around a portion of the peripheral boundary that is sufficient for allowing separation of the base-lid assembly and release of the lid from the container base.

2. The lid of claim 1, wherein said graspable members are lift tabs, and simultaneous operation of said two lift tabs leads to separation between the container lip and the peripheral groove of the lid at least at said locations of said lift tabs, leading to propagation of the separation and release of the lid from the container base.

3. The lid of claim 1, wherein said lid is dome shaped.

4. The lid of claim 1, wherein said pair of graspable members are configured to form two lift tabs.

5. The lid of claim 1, wherein said graspable members are simultaneously operable with a user's left and right hands respectively.

6. The lid of claim 1, wherein said graspable members are sequentially operable with at least one of a user's hands.

7. The lid of claim 1, wherein at least one of the graspable members further includes a press location cooperative therewith and located proximally thereto, the engagement feature lying between the graspable member and the press location, the press location enabling a user's hand to press on the press location while simultaneously lifting said at least one cooperative graspable member.

8. The lid of claim 7, further comprising a visible indication associated with each press location suggesting that pressure be applied to the press location, and a visible indication associated with each graspable member suggesting that the graspable member be lifted.

9. The lid of claim 1, wherein the graspable members are located at an angular separation of between 20 degrees and 60 degrees.

10. The lid of claim 1, wherein the graspable members are located at an angular separation of between 25 degrees and 50 degrees.

11. The lid of claim 1, wherein the material of construction of the lid is one of: polypropylene (PP), oriented polystyrene (OPS), polyethylene terephthalate (PET), styrene butadiene copolymer, and rubber modified styrene.

12. The lid of claim 1, wherein said peripheral skirt is configured for guiding said base peripheral container lip into cooperation with said lid engagement feature and facilitating formation of said base-lid assembly; the peripheral skirt being sufficiently short to enable a user to lift the container base from below when the lid is engaged with the container base.

13. A lid adapted for engagement with a container base and easy release therefrom, the lid and container base comprising:

a container base having a container bottom wall, container sidewalls that extend upwardly from said container bottom wall, and a peripheral container lip;

a lid having a lid top and a lid engagement feature extending continuously proximal to a peripheral boundary of the lid, said peripheral boundary of the lid being shaped substantially as a polygon, said lid engagement feature comprising a peripheral groove extending substantially annularly around the peripheral boundary, said peripheral groove being configured for mutual cooperation and attachment with the container base by receiving said peripheral container lip of the container base therein, thereby allowing formation of a base-lid assembly;

a peripheral skirt extending downwardly and flaring outwardly from said peripheral groove, said peripheral skirt being located below said peripheral container lip when said container base and said lid are engaged to form said base-lid assembly; and a pair of graspable members provided in said peripheral skirt of the lid in locations that are not directly opposite to each other, said graspable members being configured for grasping and flexing the peripheral skirt and disengaging the peripheral groove from the container lip at two locations, from which said disengagement propagates around a portion of the peripheral boundary that is sufficient for allowing separation of the base-lid assembly and release of the lid from the container base.

14. A lid adapted for engagement with a container base and easy release therefrom, said container base having a container bottom wall, at least one container sidewall that extends upwardly and outwardly from said container bottom wall, and a peripheral container lip, said lid comprising:

a lid top;

a lid engagement feature in the form a peripheral groove, said peripheral groove extending substantially annularly about the lid proximal to a peripheral boundary of the lid, said peripheral groove being configured for mutual cooperation and attachment with said container base by receiving said peripheral container lip of the container base therein, thereby allowing formation of a base-lid assembly;

a peripheral skirt extending downwardly and flaring outwardly from said peripheral groove, said peripheral skirt being located below said peripheral container lip when said container base and said lid are engaged to form said base-lid assembly;

a first lift tab and a second lift tab provided in said peripheral skirt of the lid and disposed at respective locations along said peripheral boundary of the lid that are not directly opposed to each other, said first and second lift tabs being operable with a user's left and right hands respectively; and a first press area proximate to said first lift tab and located relatively inwardly to said peripheral groove of the lid and a second press area proximate to said second lift tab and located relatively inwardly to said peripheral groove of the lid, said first press area being downwardly pressable by said user's left hand while said left hand is lifting said first lift tab, and said second press area being downwardly pressable by said user's right hand while said right hand is lifting said second lift tab, wherein simultaneous lifting of said first and second lift tabs while pressing said first and second press areas flexes the peripheral skirt and disengages the peripheral groove from the container lip at two locations, from which said disengagement propagates around a portion of the peripheral boundary that is sufficient for enabling separation between said lid engagement feature and said base engagement feature and leading to the release of said lid from said container base.

15. The lid of claim 14, wherein said container base is a substantially flat tray.

16. The lid of claim 14, further comprising a visible indication associated with each press area suggesting that pressure be applied to the press area, and a visible indication associated with each lift tab suggesting that the lift tab be lifted.

17. The lid of claim 14, wherein said peripheral skirt extends between 0.1" and 0.3" below said peripheral container lip of said container base.

18. The lid according to claim 14, wherein said peripheral skirt extends about 0.2" below said peripheral container lip of said container base.

19. The lid according to claim 14, wherein said lid is made by a thermoforming process.

20. The lid according to claim 14, wherein said lid is made by an injection molding process.

21. The lid according to claim 14, wherein said lid is made from polypropylene (PP) resin.

22. The lid according to claim 14, wherein said lid is made from polyethylene terephthalate (PET) resin.

23. The lid according to claim 14, wherein said lid is thermoformed from an oriented polystyrene sheet.

24. The lid of claim 13, wherein said graspable members are lift tabs, and simultaneous operation of said two lift tabs leads to separation of the engagement features at least at said locations of said lift tabs, leading to propagation of the separation, release of the peripheral container lip from the peripheral groove, and separation of the lid from the container base.

25. The lid of claim 13, wherein said lid is dome shaped.

26. The lid of claim 13, wherein said pair of graspable members are configured to form two lift tabs.

27. The lid of claim 13, wherein said graspable members are simultaneously operable with a user's left and right hands respectively.

28. The lid of claim 13, wherein said graspable members are sequentially operable with at least one of a user's hands.

29. The lid of claim 13, wherein at least one of the graspable members further includes a press location cooperative therewith and located proximally thereto, the engagement feature lying between the graspable member and the press location, the press location enabling a user's hand to press on the press location while simultaneously lifting said at least one cooperative graspable member.

30. The lid of claim 29, further comprising a visible indication associated with each press location suggesting that pressure be applied to the press location, and a visible indication associated with each graspable member suggesting that the graspable member be lifted.

31. The lid of claim 13, wherein the material of construction of the lid is one of: polypropylene (PP), oriented polystyrene (OPS), polyethylene terephthalate (PET), styrene butadiene copolymer, and rubber modified styrene.

32. The lid of claim 13, wherein, the peripheral skirt is configured for guiding said base peripheral container lip into cooperation with said lid engagement feature and facilitating formation of said base-lid assembly; the peripheral skirt being sufficiently short to enable a user to lift the container base from below when the lid is engaged with the container base.

33. The lid of claim 13, wherein at least one of the at least one of the graspable members is located at a vertex of the peripheral boundary of the lid.

34. The lid of claim 13, wherein the pair of graspable members are located adjacent to either side of a vertex of the peripheral boundary of the lid.

* * * * *